US007951292B1

(12) United States Patent
De La Torre

(10) Patent No.: US 7,951,292 B1
(45) Date of Patent: May 31, 2011

(54) SINK FILTER DEVICE

(76) Inventor: David De La Torre, Long Beach, CA (US)

( * ) Notice: Subject to any disclaimer, the term of this patent is extended or adjusted under 35 U.S.C. 154(b) by 64 days.

(21) Appl. No.: 12/403,322

(22) Filed: Mar. 12, 2009

(51) Int. Cl.
*B01D 29/01* (2006.01)
*B01D 35/02* (2006.01)

(52) U.S. Cl. ..... 210/164; 210/336; 210/482; 210/489; 4/655; 4/289; 4/292

(58) Field of Classification Search ..... 210/163, 210/164, 335, 336, 473, 482, 489; 4/654, 4/655, 289, 290, 292
See application file for complete search history.

(56) References Cited

U.S. PATENT DOCUMENTS

| | | | | | |
|---|---|---|---|---|---|
| 1,524,547 | A | * | 1/1925 | Giacobbe | 210/489 |
| 2,069,939 | A | * | 2/1937 | Browning | 210/489 |
| 2,285,833 | A | * | 6/1942 | Platt | 4/292 |
| 2,820,985 | A | * | 1/1958 | Cresswell | 210/489 |
| 3,334,750 | A | * | 8/1967 | Ullman, Jr. | 210/489 |
| 3,907,513 | A | * | 9/1975 | Sheinberg | 55/525 |
| 4,351,073 | A | | 9/1982 | Elsas | |
| 4,443,897 | A | | 4/1984 | Austin | |
| 4,721,567 | A | * | 1/1988 | Uram | 210/489 |
| 5,216,764 | A | | 6/1993 | Hall et al. | |
| D380,527 | S | | 7/1997 | Velez | |
| 5,815,856 | A | | 10/1998 | Dore | |
| 5,824,218 | A | * | 10/1998 | Gasser et al. | 210/489 |
| 5,862,535 | A | | 1/1999 | Noga et al. | |
| 5,991,942 | A | | 11/1999 | Neal | |
| 6,173,455 | B1 | | 1/2001 | Nordstrom | |
| 6,303,032 | B1 | * | 10/2001 | Genduso | 4/290 |
| 6,925,964 | B2 | * | 8/2005 | Jeffery | 4/292 |
| 7,325,694 | B2 | | 2/2008 | Bushey | |
| 2005/0223481 | A1 | | 10/2005 | Giacomi | |

* cited by examiner

*Primary Examiner* — Christopher Upton

(57) ABSTRACT

A sink filter device for placing inside a sink bowl of a sink or a shower or tub comprising a first sheet; a second sheet atop the first sheet; and a plurality of pores disposed throughout the first sheet and throughout the second sheet. In some embodiments, the pores are between about 50 μm to 5 mm in diameter. The second sheet is oriented atop the first sheet such that the pores in the second sheet are slightly aligned with the pores in the first sheet.

3 Claims, 3 Drawing Sheets

SINK FILTER DEVICE

FIELD OF THE INVENTION

The present invention is directed to a sieve-like device for inserting into a bathroom or kitchen sink to prevent particles such as hair or food from entering into the sink drain.

BACKGROUND OF THE INVENTION

Homeowners may commonly find clogged drains in their home. This is a result of hairs, lint, debris, and/or food from going down the drains. The present invention features a sink filter device that prevents debris from entering into a drain of a sink, shower, or tub.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
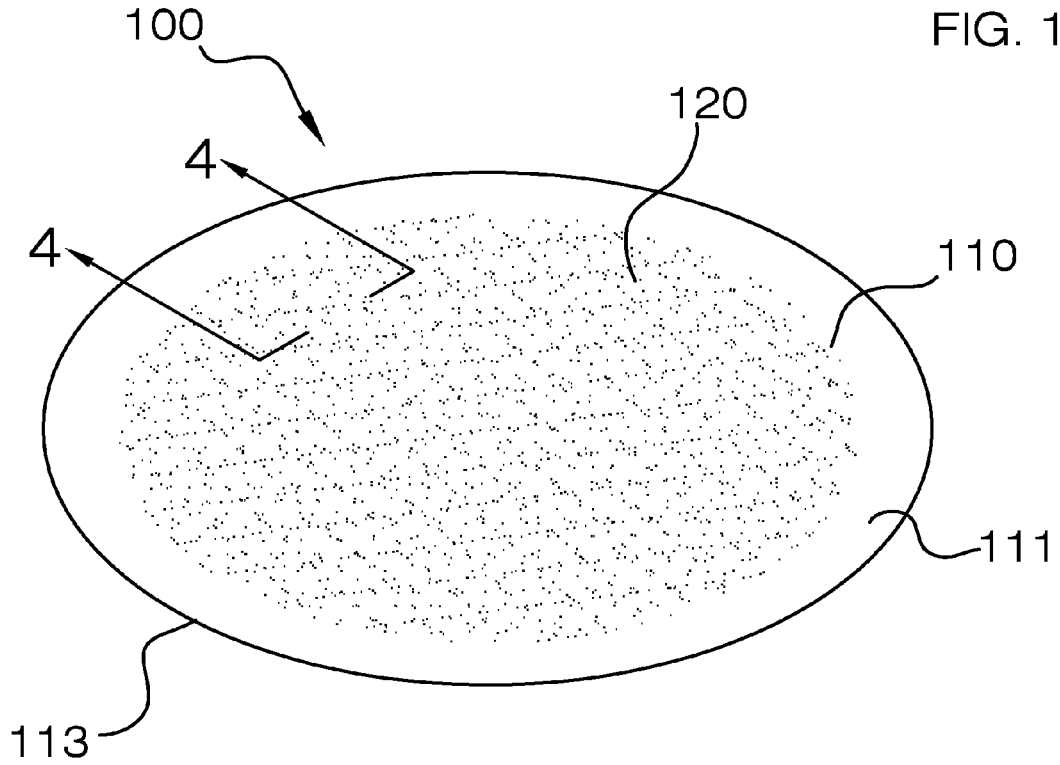
FIG. 1 is a perspective view of the sink filter device of the present invention.
Figure 2:
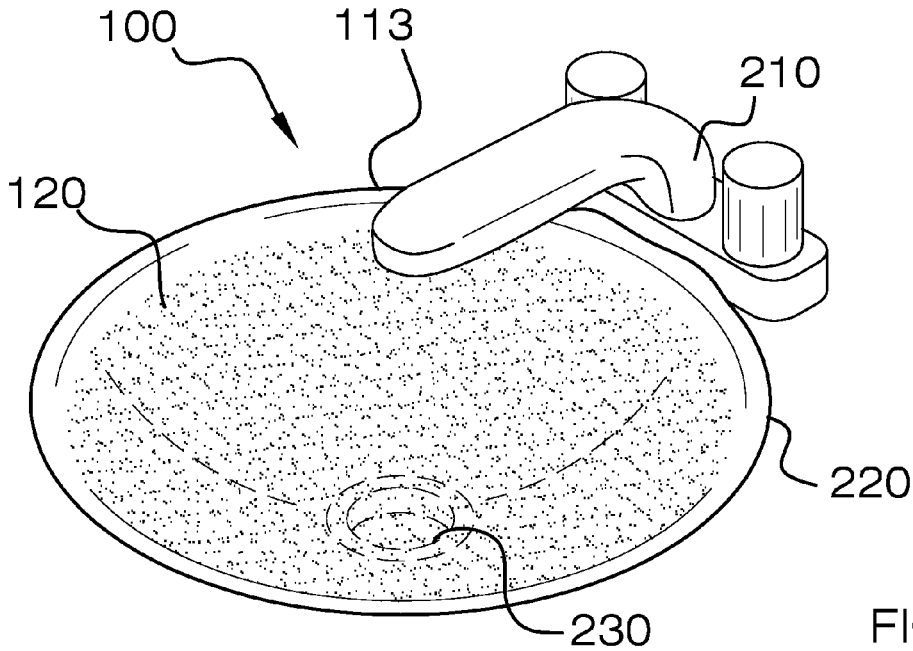
FIG. 2 is a perspective view of the sink filter device of the present invention, wherein the device is placed in a sink.
Figure 3:
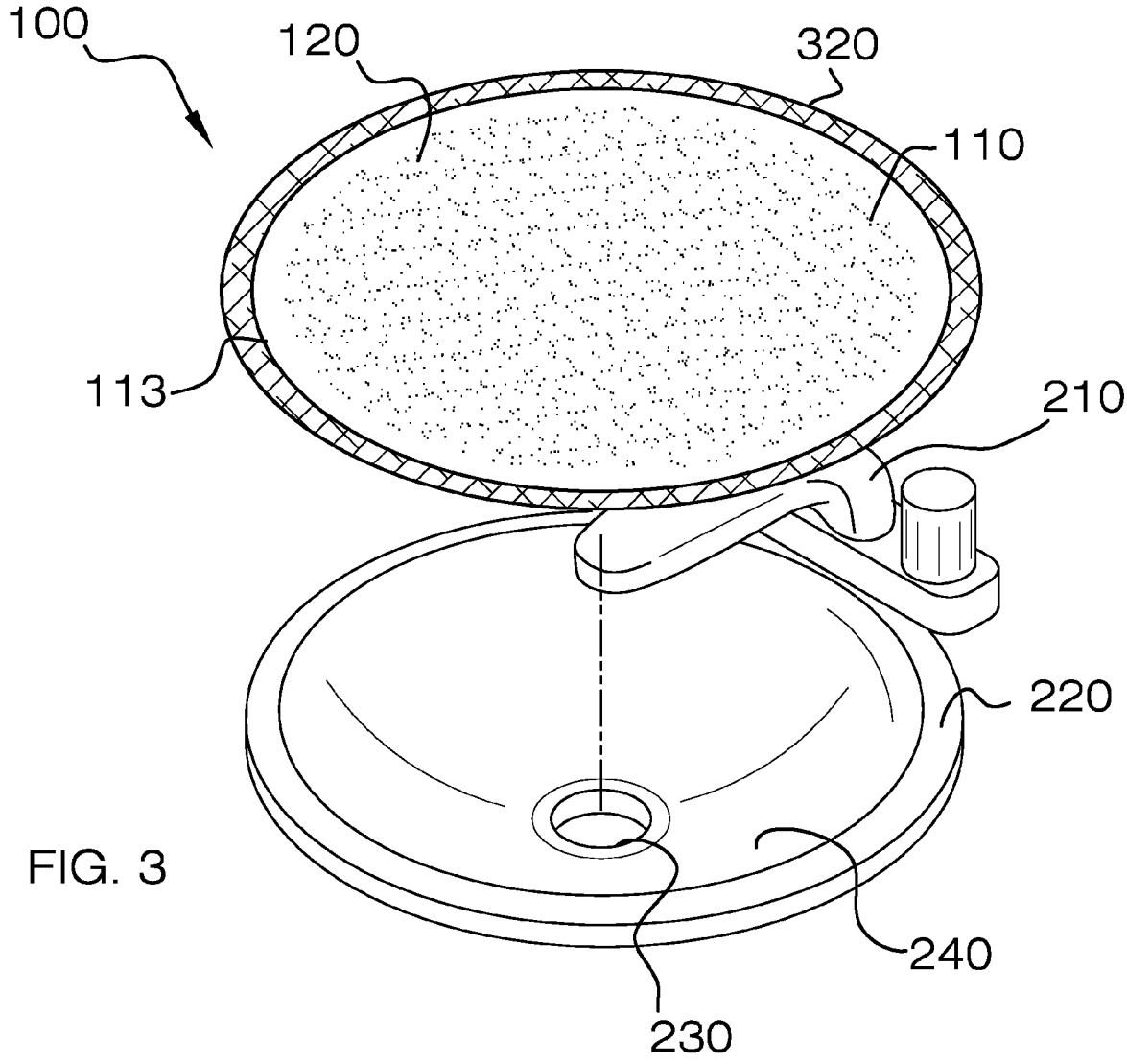
FIG. 3 is a perspective view of the sink filter device of the present invention.
Figure 4:
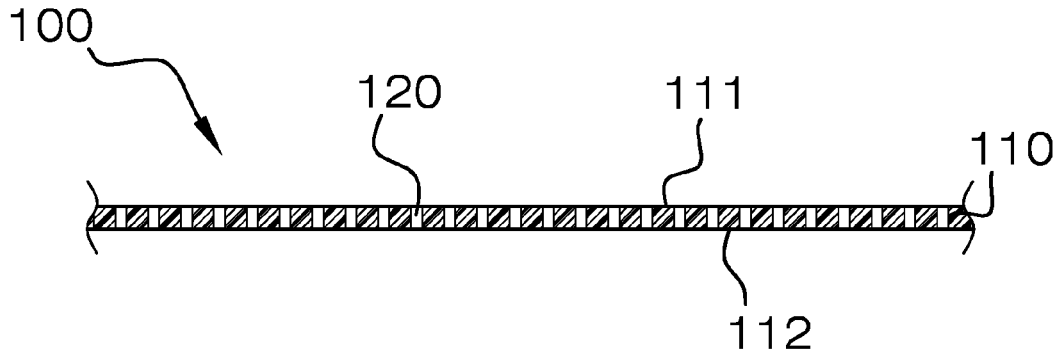
FIG. 4 is a side cross sectional view of the sink filter device of the present invention.
Figure 5A:
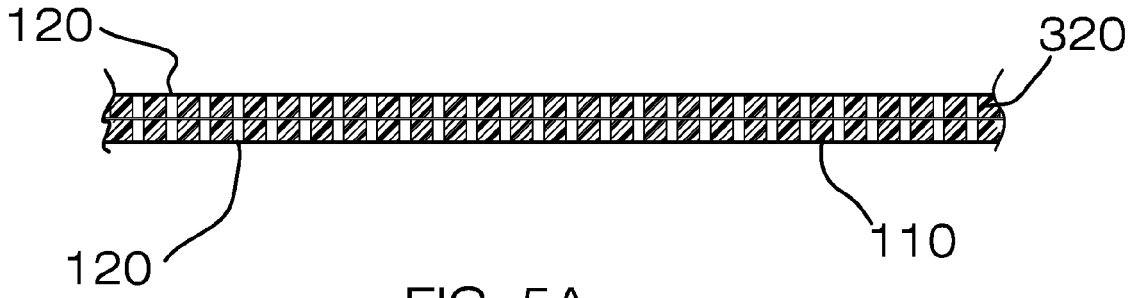
FIG. 5A and FIG. 5B are side cross sectional views of the sink filter device of the present invention.
Figure 5B:
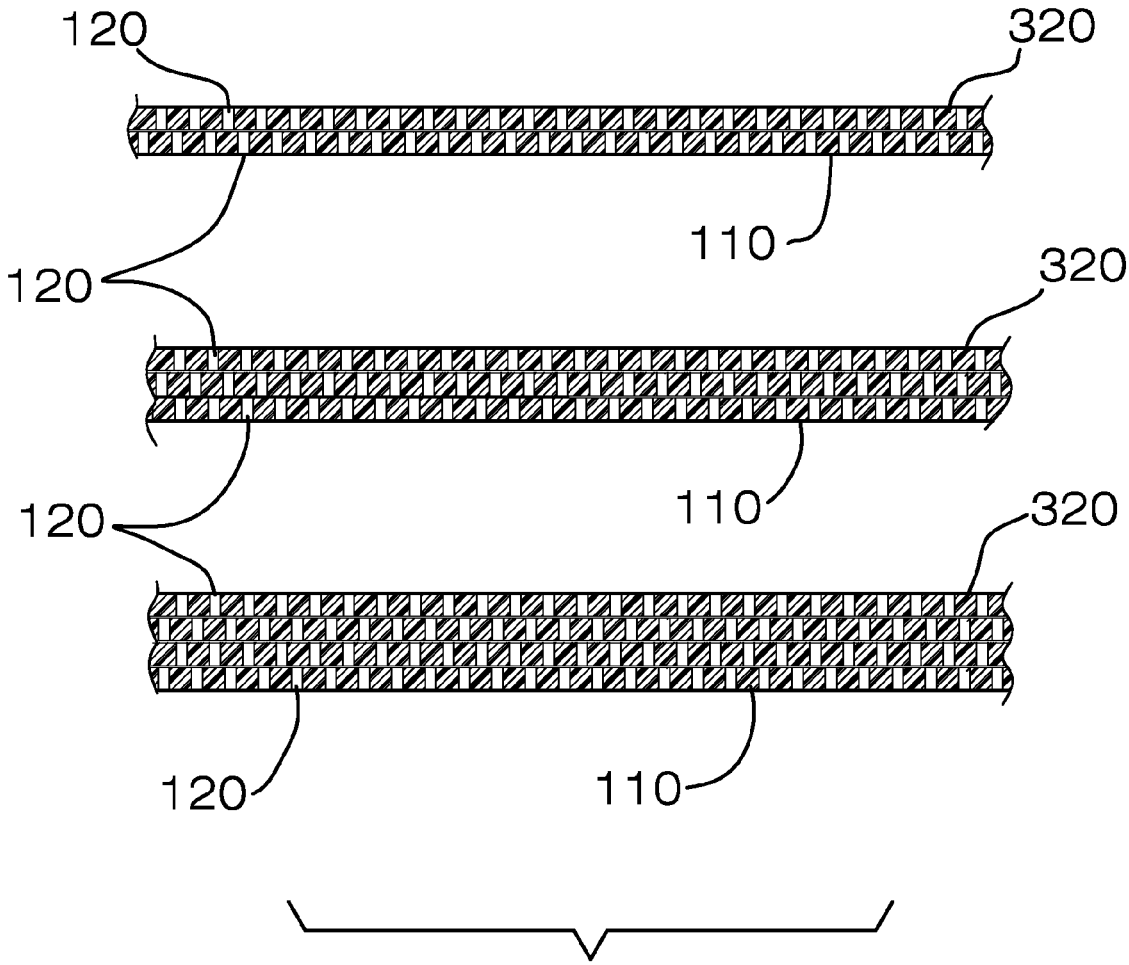

The following is a listing of numbers corresponding to a particular element refer to herein:

100 sink filter device
110 sheet
111 top surface of sheet
112 bottom surface of sheet
113 outer circumference of sheet
120 pores
210 bathroom sink
220 lip of sink
230 drain
240 inside of sink bowl
320 second sheet Referring now to FIGS. 1-5, the present invention features a sink filter device 100 for attaching to a sink 210. In some embodiments, the sink filter device 100 is laid on the inside of a sink bowl 240. The sink filter device 100 may also be used in a shower or tub.

The sink filter device 100 comprises a first sheet 110 having a top surface 111, a bottom surface 112, and an outer circumference 113. Disposed throughout the first sheet 110 is a plurality of pores 120. In some embodiments, the sink filter device 100 is used in a bathroom sink 210 and the pores 120 are for catching small particles such as hairs and preventing them from going into the drain 230. In some embodiments, the sink filter device 100 is used in a kitchen sink and the pores 120 are for catching food particles and preventing them from going into the drain.

The sink filter device 100 can be placed in a sink 210 such that the bottom surface 112 is in contact with the surface of the sink 210.

In some embodiments, the sink filter device 100 further comprises a second sheet 320 atop the first sheet 110. A plurality of pores 120 is disposed throughout the second sheet 320. In some embodiments, the second sheet 320 is oriented atop the first sheet 110 such that the pores 120 in the second sheet 320 are slightly aligned but not completely aligned with the pores 120 in the first sheet 110 (see FIG. 5A). In some embodiments, the second sheet 320 is oriented atop the first sheet 110 such that the pores 120 in the second sheet 320 are not at all aligned with the pores 120 in the first sheet 110 (see FIG. 5B).

In some embodiments, the sink filter device 100 further comprises a third sheet atop the second sheet 320. In some embodiments, the sink filter device further comprises a fourth sheet atop the third sheet.

The first sheet 110 (and/or second sheet 320) may be constructed from a variety of materials. In some embodiments, the first sheet 110 (and/or second sheet 320) is constructed from a material comprising a plastic. In some embodiments, the first sheet 110 (and/or second sheet 320) is constructed from a material comprising a plastic, a textile, the like, or a combination thereof.

The pores 120 may be of a variety of sizes. The pores 120 allow water to easily pass through the first sheet 110 but prevent particles from passing through. In some embodiments, the pores are between about 0.2 to 0.5 μm in diameter. In some embodiments, the pores are between about 0.5 to 1.0 μm in diameter. In some embodiments, the pores are between about 1.0 to 5.0 μm in diameter. In some embodiments, the pores are between about 5.0 to 10 μm in diameter. In some embodiments, the pores are between about 10 to 50 μm in diameter. In some embodiments, the pores are between about 50 to 100 μm in diameter. In some embodiments, the pores are between about 100 μm to 1 mm in diameter. In some embodiments, the pores are between about 1 to 5 mm in diameter. In some embodiments, the pores are more than about 5 mm in diameter.

In some embodiments, an elastic strap 320 is disposed along the outer circumference 113 of the first sheet 110 (and/or second sheet 320). The elastic strap 320 may be used to attach the sink filter device 100 to a sink. For example, the elastic strap 320 may be wrapped around the lip of the sink 220. The elastic strap 320 may help to keep the sink filter device 100 in place while it is in the sink 210.

In some embodiments, the sink filter device 100 of the present invention is disposable. For example, in some embodiments, a user may place a sink filter device 100 into his/her bathroom sink 210. After one or more uses, he/she may dispose of the sink filter device 100 and place a new sink filter device 100 into the sink 210.

The following the disclosures of the following U.S. Patents are incorporated in their entirety by reference herein: U.S. Pat. No. 7,325,694; U.S. Pat. No. 6,173,455; U.S. Pat. No. 5,991,942; U.S. Pat. No. 5,815,856; U.S. Pat. No. 5,862,535; U.S. Pat. No. 4,351,073; U.S. Pat. Application No. 2005/0223481; U.S. Pat. No. 5,216,764; U.S. Pat. No. 4,443,897.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A sink filter device for placing inside a sink bowl of a sink, said sink filter device comprising:

(a) a first sheet;

(b) a second sheet atop the first sheet; and (c) a plurality of pores disposed throughout the first sheet and throughout the second sheet; wherein the pores are between about 50 μm to 5 mm in diameter;

wherein the second sheet is oriented atop and adjacent to the first sheet such that the pores in the second sheet are slightly aligned with the pores in the first sheet and there is nothing separating the first sheet from being in contact with the second sheet; wherein the first and second sheets are flat and contain no holes larger than the pores; wherein the bottom surface of the first sheet is in contact with the surface of the sink.

2. The sink filter device of claim 1, wherein an elastic strap is disposed along an outer circumference of the first sheet, wherein the elastic strap is for securing the sink filter device to a lip of the sink.

3. The sink filter device claim 1, wherein the first sheet and the second sheet are constructed from a material comprising a plastic.

* * * * *